US008259052B2

(12) United States Patent
Lee et al.

(10) Patent No.: US 8,259,052 B2
(45) Date of Patent: Sep. 4, 2012

(54) APPARATUS AND METHOD FOR DRIVING LIQUID CRYSTAL DISPLAY WITH A MODULATED DATA VOLTAGE FOR AN ACCELERATED RESPONSE SPEED OF THE LIQUID CRYSTAL

(75) Inventors: Seok Woo Lee, Guro-gu (KR); Nam Hee Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 2054 days.

(21) Appl. No.: 11/204,188

(22) Filed: Aug. 15, 2005

(65) Prior Publication Data

US 2006/0197733 A1 Sep. 7, 2006

(30) Foreign Application Priority Data

Mar. 7, 2005 (KR) ..... 10-2005-0018626

(51) Int. Cl.
*G09G 3/36* (2006.01)

(52) U.S. Cl. ..... 345/94; 345/100

(58) Field of Classification Search ..... 345/87, 345/89, 98–100, 690, 691, 94
See application file for complete search history.

(56) References Cited

U.S. PATENT DOCUMENTS

| | | | | |
|---|---|---|---|---|
| 6,522,318 | B1 | 2/2003 | Kumagawa et al. | |
| 6,664,943 | B1 * | 12/2003 | Nakajima et al. | 345/98 |
| 2001/0040548 | A1 * | 11/2001 | Ikeda | 345/99 |
| 2002/0063674 | A1 * | 5/2002 | Chiang | 345/98 |
| 2002/0196218 | A1 | 12/2002 | Ham | |
| 2002/0196224 | A1 | 12/2002 | Ham | |
| 2003/0048246 | A1 | 3/2003 | Ham | |
| 2003/0128176 | A1 | 7/2003 | Ham | |
| 2004/0196229 | A1 | 10/2004 | Ham | |
| 2005/0156852 | A1 | 7/2005 | Kwon | |

FOREIGN PATENT DOCUMENTS

| | | | |
|---|---|---|---|
| CN | 1407532 | A | 4/2003 |
| GB | 2 342 754 | A | 4/2000 |
| JP | S61-240291 | | 10/1986 |
| JP | 07-334126 | | 12/1995 |
| JP | 08-076083 | | 3/1996 |

(Continued)

OTHER PUBLICATIONS

Office Action for corresponding German Patent Application Serial No. 10 2005 048 206.3-32, dated Jan. 16, 2008.
First Office Action for corresponding Chinese Patent Application Serial No. 2005101095781, dated Nov. 16, 2007.
Office Action issued in corresponding German Patent Application No. 10 2005 048 206.3-32; dated Jun. 19, 2008.

(Continued)

*Primary Examiner* — Chanh Nguyen
*Assistant Examiner* — Allison Walthall
(74) *Attorney, Agent, or Firm* — Brinks Hofer Gilson & Lione

(57) ABSTRACT

An apparatus and method for driving a liquid crystal display device are disclosed in which the response speed of the liquid crystal can be increased without using a digital memory. The driving apparatus includes a liquid crystal panel with gate lines and data lines arranged perpendicularly to each other, a gate driver that supplies a gate pulse to the gate lines, and a data driver. The data driver samples an input N-bit digital data signal to generate an analog data voltage, generates a modulated data voltage for acceleration of a response speed of the liquid crystal according to an M-bit data value of the sampled digital data signal, mixes the modulated data voltage with the analog data voltage, and supplies the mixed data voltage to the data lines.

32 Claims, 15 Drawing Sheets

FOREIGN PATENT DOCUMENTS

| | | |
|---|---|---|
| JP | 08-146389 | 6/1996 |
| JP | 08-327974 | 12/1996 |
| JP | 8327974 | 12/1996 |
| JP | 10-105126 | 4/1998 |
| JP | 2001-166731 | 6/2001 |
| JP | 2002-91364 | 3/2002 |
| JP | 2003-084739 | 3/2003 |
| KR | 1020040059319 | 7/2004 |
| WO | WO 2004/013835 | 2/2004 |

OTHER PUBLICATIONS

Examiner's Office Letter issued in corresponding Japanese Patent Application No. 2005-344972; issued Apr. 7, 2008.

Japanese Office Action issued in corresponding Japanese Patent Application No. 2005-344972; issued Sep. 9, 2009.

Search Report issued in corresponding French Patent Application No. FR 0511054; issued Feb. 16, 2010.

* cited by examiner

APPARATUS AND METHOD FOR DRIVING LIQUID CRYSTAL DISPLAY WITH A MODULATED DATA VOLTAGE FOR AN ACCELERATED RESPONSE SPEED OF THE LIQUID CRYSTAL

This application claims the benefit of Korean Patent Application No. P05-18626, filed on, Mar. 7, 2005 which is hereby incorporated by reference as if fully set forth herein.

FIELD OF THE INVENTION

The present invention relates to a liquid crystal display device, and more particularly, to an apparatus and method for driving a liquid crystal display device, wherein the response speed of a liquid crystal can be increased even without using a memory, thereby preventing degradation in picture quality.

DISCUSSION OF THE RELATED ART

Liquid crystal display devices have been used in may different types of electronic equipment. Liquid crystal display devices adjust light transmittance of liquid crystal cells according to a video signal so as to display an image. An active matrix type liquid crystal display device has a switching element formed for every liquid crystal cell and is suitable for the display of a moving image. A thin film transistor (TFT) is mainly used as the switching element in the active matrix type liquid crystal display device.

However, the liquid crystal display device has a relatively slow response speed due to characteristics such as the inherent viscosity and elasticity of a liquid crystal, as can be seen from the following Equations 1 and 2:

$$\tau_r \propto \frac{\gamma d^2}{\Delta\varepsilon|Va^2 - V_F^2|} \quad \text{[Equation 1]}$$

where $\tau_r$ is a rising time when a voltage is applied to the liquid crystal, Va is the applied voltage, $V_F$ is a Freederick transition voltage at which liquid crystal molecules start to be inclined, d is a liquid crystal cell gap, and $\gamma$ is the rotational viscosity of the liquid crystal molecules.

$$\tau_F \propto \frac{\gamma d^2}{K} \quad \text{[Equation 2]}$$

where $\tau_F$ is a falling time when the liquid crystal is returned to its original position owing to an elastic restoration force after the voltage applied to the liquid crystal is turned off, and K is the inherent elastic modulus of the liquid crystal.

In a twisted nematic (TN) mode, although the response speed of the liquid crystal may be different according to the physical properties and cell gap of the liquid crystal, it is common that the rising time is 20 to 80 ms and the falling time is 20 to 30 ms. Because this liquid crystal response speed is longer than one frame period (16.67 ms in National Television Standards Committee (NTSC)) of a moving image, the response of the liquid crystal proceeds to the next frame before a voltage being charged on the liquid crystal reaches a desired level, as shown in FIG. 1, resulting in motion blurring in which an afterimage is left in the eyeplane.

With reference to FIG. 1, a conventional liquid crystal display device cannot express a desired color and brightness for display of a moving image in that, when data VD is changed from one level to another level, the corresponding display brightness level BL is unable to reach a desired value due to a slow response of the liquid crystal display device. As a result, the motion blurring occurs in the moving image, causing degradation in contrast ratio and, in turn, degradation in display quality.

In order to solve the low response speed of the liquid crystal display device, U.S. Pat. No. 5,495,265 and PCT International Publication No. WO 99/09967 has proposed a method for modulating data according to a variation therein using a look-up table (referred to hereinafter as a 'high-speed driving method'). This high-speed driving method is adapted to modulate data on the basis of a principle as shown in FIG. 2.

With reference to FIG. 2, the conventional high-speed driving method includes modulating input data VD and applying the modulated data MVD to a liquid crystal cell to obtain a desired brightness level MBL. In this high-speed driving method, in order to obtain the desired brightness level corresponding to the luminance of the input data in one frame period, the response of a liquid crystal is rapidly accelerated by increasing $|Va^2-V_F^2|$ in the Equation 1 on the basis of a variation in the input data.

Accordingly, a conventional liquid crystal display device using the high-speed driving method is able to compensate for a slow response of a liquid crystal by modulation of a data value to relax motion blurring in a moving image, so as to display a picture with a desired color and brightness.

In detail, in order to reduce the memory capacity burden in the hardware implementation, the conventional high-speed driving method performs modulation by comparing only respective most significant bits MSB of a previous frame Fn−1 and current frame Fn with each other, as shown in FIG. 3. In other words, the conventional high-speed driving method compares respective most significant bit data MSB of the previous frame Fn−1 and current frame Fn with each other to determine whether there is a variation between the two most significant bit data MSB. If there is a variation between the two most significant bit data MSB, the corresponding modulated data MRGB is selected from a look-up table as most significant bit data MSB of the current frame Fn.

FIG. 4 shows the configuration of a conventional high-speed driving apparatus in which the aforementioned high-speed driving method is implemented.

With reference to FIG. 4, the conventional high-speed driving apparatus comprises a frame memory 43 connected to a most significant bit bus line 42, and a look-up table 44 connected in common to output terminals of the most significant bit bus line 42 and frame memory 43.

The frame memory 43 stores most significant bit data MSB for one frame period and supplies the stored data to the look-up table 44. Here, the most significant bit data MSB is set to four most significant bits of 8-bit source data RGB.

The look-up table 44 compares most significant bit data MSB of a current frame Fn inputted from the most significant bit bus line 42 with most significant bit data MSB of a previous frame Fn−1 inputted from the frame memory 43, as in Table 1 below, and selects modulated data MRGB corresponding to the comparison result. The modulated data MRGB is added to least significant bit data LSB from a least significant bit bus line 41 and then supplied to a liquid crystal display device.

Where the most significant bit data MSB is limited to four bits, the modulated data MRGB registered in the look-up table 44 of the high-speed driving apparatus and method is as follows:

TABLE 1

| | | Current Frame | | | | | | | | | | | | | | | |
|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 |
| Previous Frame | 0 | 0 | 1 | 3 | 4 | 6 | 7 | 9 | 10 | 11 | 12 | 14 | 15 | 15 | 15 | 15 | 15 |
| | 1 | 0 | 1 | 2 | 4 | 5 | 7 | 9 | 10 | 11 | 12 | 13 | 14 | 15 | 15 | 15 | 15 |
| | 2 | 0 | 1 | 2 | 3 | 5 | 7 | 8 | 9 | 10 | 12 | 13 | 14 | 15 | 15 | 15 | 15 |
| | 3 | 0 | 1 | 2 | 3 | 5 | 6 | 8 | 9 | 10 | 11 | 12 | 14 | 14 | 15 | 15 | 15 |
| | 4 | 0 | 0 | 1 | 2 | 4 | 6 | 7 | 9 | 10 | 11 | 12 | 13 | 14 | 15 | 15 | 15 |
| | 5 | 0 | 0 | 0 | 2 | 3 | 5 | 7 | 8 | 9 | 11 | 12 | 13 | 14 | 15 | 15 | 15 |
| | 6 | 0 | 0 | 0 | 1 | 3 | 4 | 6 | 8 | 9 | 10 | 11 | 13 | 14 | 15 | 15 | 15 |
| | 7 | 0 | 0 | 0 | 1 | 2 | 4 | 5 | 7 | 8 | 10 | 11 | 12 | 14 | 14 | 15 | 15 |
| | 8 | 0 | 0 | 0 | 1 | 2 | 3 | 5 | 6 | 8 | 9 | 11 | 12 | 13 | 14 | 15 | 15 |
| | 9 | 0 | 0 | 0 | 1 | 2 | 3 | 4 | 6 | 7 | 9 | 10 | 12 | 13 | 14 | 15 | 15 |
| | 10 | 0 | 0 | 0 | 0 | 1 | 2 | 4 | 5 | 7 | 8 | 10 | 11 | 13 | 14 | 15 | 15 |
| | 11 | 0 | 0 | 0 | 0 | 0 | 2 | 3 | 5 | 6 | 7 | 9 | 11 | 12 | 14 | 15 | 15 |
| | 12 | 0 | 0 | 0 | 0 | 0 | 1 | 3 | 4 | 5 | 7 | 8 | 10 | 12 | 13 | 15 | 15 |
| | 13 | 0 | 0 | 0 | 0 | 0 | 1 | 2 | 3 | 4 | 6 | 8 | 10 | 11 | 13 | 14 | 15 |
| | 14 | 0 | 0 | 0 | 0 | 0 | 0 | 1 | 2 | 3 | 5 | 7 | 9 | 11 | 13 | 14 | 15 |
| | 15 | 0 | 0 | 0 | 0 | 0 | 0 | 0 | 1 | 2 | 4 | 6 | 9 | 11 | 13 | 14 | 15 |

In the above Table 1, the leftmost column represents the data voltage VDn−1 of the previous frame Fn−1 and the uppermost row represents the data voltage VDn of the current frame Fn. Also, the Table 1 includes look-up table information obtained by expressing four most significant bits in decimal form.

In the above-mentioned high-speed driving apparatus and method, a digital memory, such as the look-up table 44, is used to generate modulated data MRGB by comparing the data of the previous frame Fn−1 and current frame Fn with each other. The use of the digital memory increases chip size as well as manufacturing costs.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
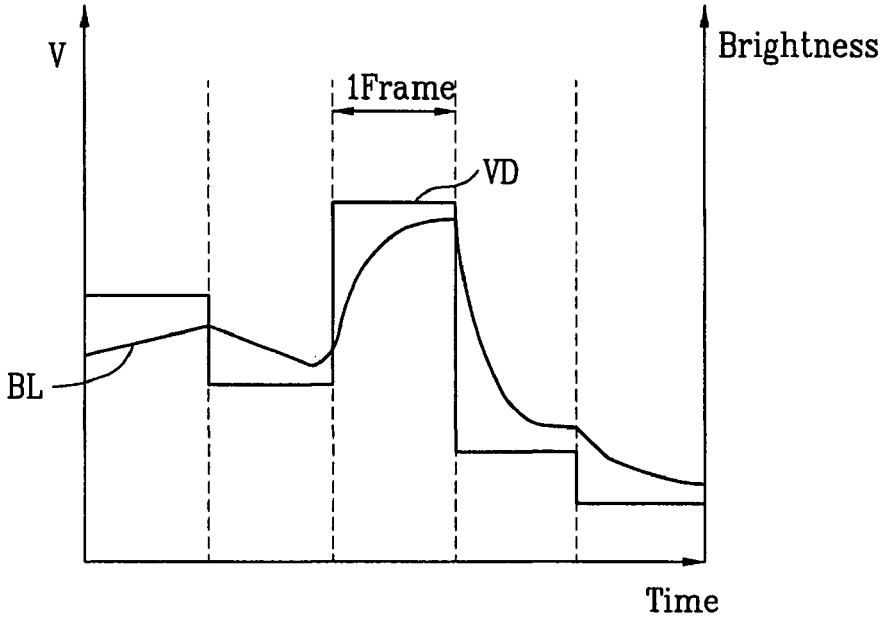
FIG. 1 Related Art
FIG. 1 is a waveform diagram illustrating a data-dependent brightness variation in a conventional liquid crystal display device.
Figure 2:
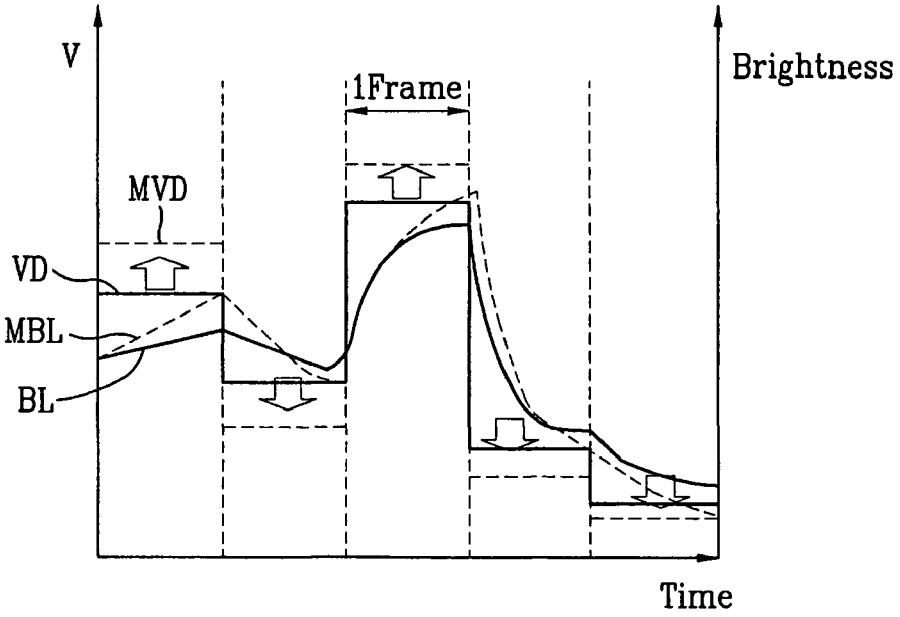
FIG. 2 Related Art
FIG. 2 is a waveform diagram illustrating a data modulation-dependent brightness variation in a conventional high-speed driving method of a liquid crystal display device.
Figure 3:
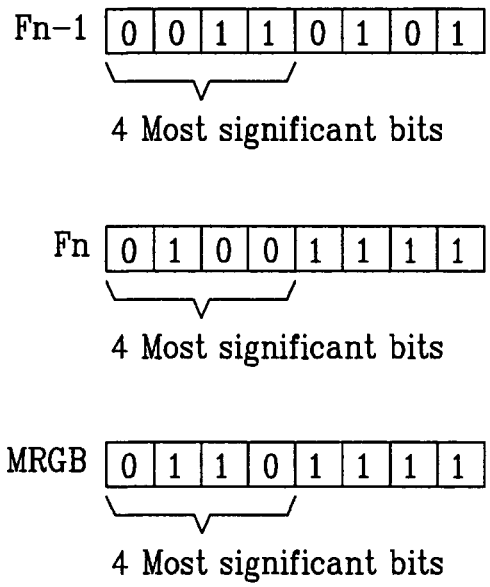
FIG. 3 Related Art
FIG. 3 is a view illustrating most significant bit data modulation in a conventional high-speed driving apparatus of a liquid crystal display device.
Figure 4:
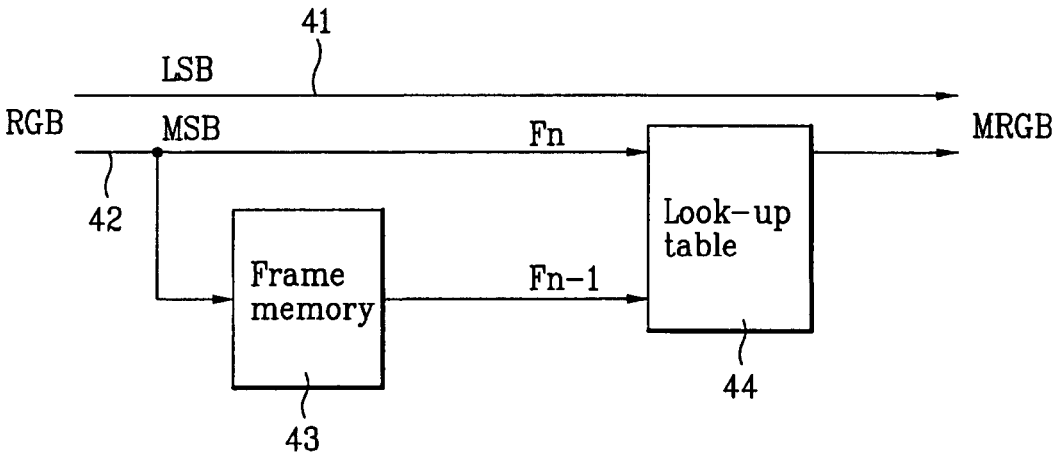
FIG. 4 Related Art
FIG. 4 is a block diagram of the conventional high-speed driving apparatus.
Figure 5:
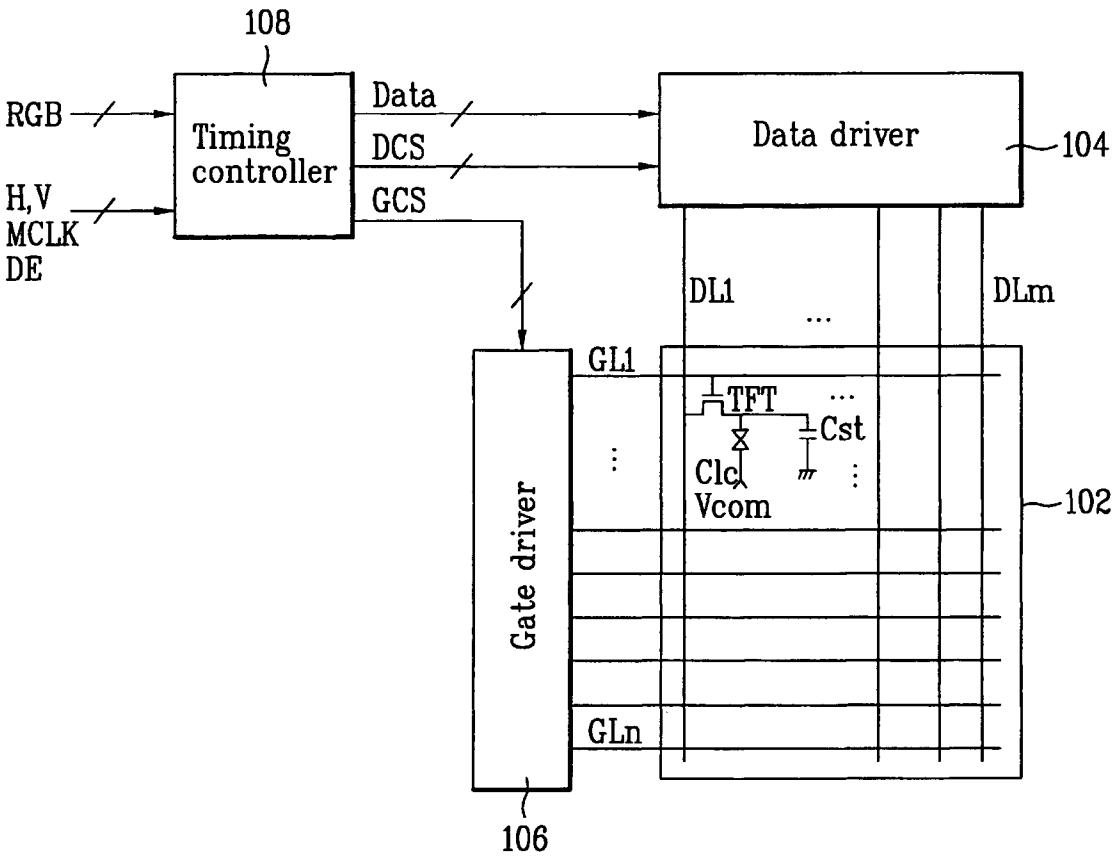
FIG. 5 is a block diagram schematically showing the configuration of a driving apparatus of a liquid crystal display device according to an embodiment of the present invention.

FIG. 5 is a block diagram schematically showing the configuration of a driving apparatus of a liquid crystal display device according to an embodiment of the present invention.

With reference to FIG. 5, the driving apparatus of the liquid crystal display device according to the embodiment of the present invention comprises a liquid crystal panel 102 including a plurality of gate lines GL1 to GLn and a plurality of data lines DL1 to DLm arranged perpendicularly to each other for defining cell areas, a gate driver 106 for driving the gate lines GL1 to GLn of the liquid crystal panel 102, and a data driver 104 for sampling an input N-bit (where N is a positive integer) digital data signal Data, generating an analog data voltage Vdata corresponding to the sampled N-bit digital data signal Data, generating a modulated data voltage Vmdata for acceleration of the response speed of a liquid crystal according to an M-bit (where M is a positive integer smaller than or equal to N) data value of the sampled N-bit digital data signal Data, mixing the modulated data voltage Vmdata with the analog data voltage Vdata, and supplying the mixed data voltage to the data lines DL. The driving apparatus of the liquid crystal display device further comprises a timing controller 108 for controlling driving timings of the data and gate drivers 104 and 106 and supplying the digital data signal Data to the data driver 104.

The liquid crystal panel 102 further includes a plurality of thin film transistors (TFTs) formed respectively at intersections of the gate lines GL1 to GLn and the data lines DL1 to DLm, and a plurality of liquid crystal cells connected respectively to the TFTs. Each TFT supplies an analog data voltage from an associated one of the data lines DL1 to DLm to an associated one of the liquid crystal cells in response to a gate pulse from an associated one of the gate lines GL1 to GLn. Each liquid crystal cell can be equivalently expressed as a liquid crystal capacitor Clc because it is provided with a common electrode facing via the liquid crystal, and a pixel electrode connected to the associated TFT. This liquid crystal cell includes a storage capacitor Cst for maintaining an analog data voltage charged on the liquid crystal capacitor Clc until the next data signal is charged thereon.

The timing controller 108 arranges source data RGB externally supplied thereto into a digital data signal Data appropriate to the driving of the liquid crystal panel 102, and supplies the arranged digital data signal Data to the data driver 104. The timing controller 108 also generates a data control signal DCS and a gate control signal GCS using a main clock MCLK, a data enable signal DE, and horizontal and vertical synchronous signals Hsync and Vsync externally inputted thereto, and applies the generated data control signal DCS and gate control signal GCS respectively to the data and gate drivers 104 and 106 to control the driving timings thereof.

The gate driver 106 sequentially generates and supplies a gate pulse to the gate lines GL1 to GLn in response to the gate control signal GCS from the timing controller 108 to turn the TFTs on/off. The gate control signal GCS preferably includes a gate start pulse GSP, a gate shift clock GSC, and a gate output enable signal GOE. The gate pulse preferably includes a gate high voltage VGH for turning the TFTs on, and a gate low voltage VGL for turning the TFTs off.

The data driver 104 samples the N-bit (where N is a positive integer) digital data signal Data from the timing controller 108 in response to the data control signal DCS therefrom, generates the analog data voltage Vdata corresponding to the sampled N-bit digital data signal Data, generates the modulated data voltage Vmdata for acceleration of the response speed of the liquid crystal according to the M-bit (where M is a positive integer smaller than or equal to N) data value of the sampled N-bit digital data signal Data, mixes the modulated data voltage Vmdata with the analog data voltage Vdata, and supplies the mixed data voltage to the data lines DL.

Figure 6:
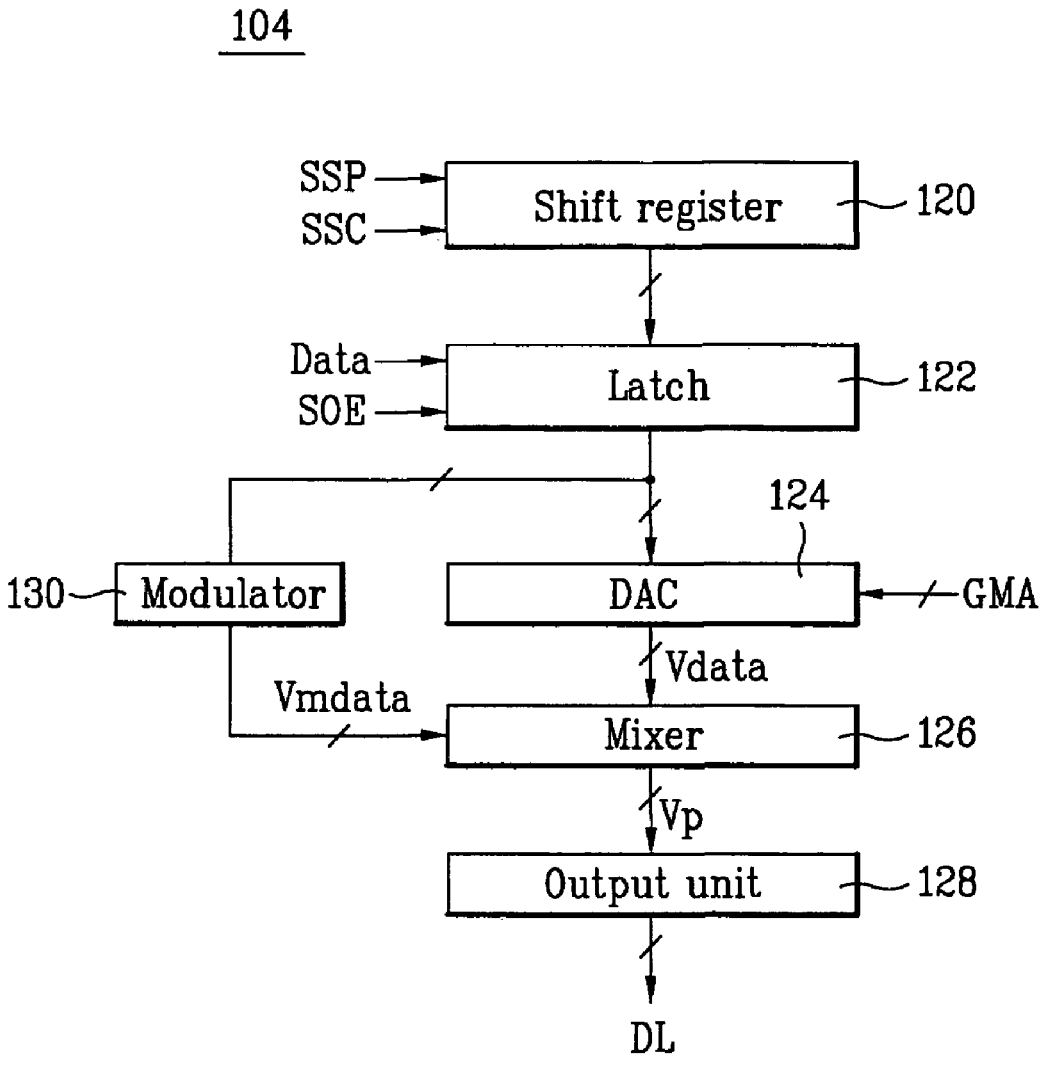
FIG. 6 is a schematic view of a data driver in FIG. 5.

To this end, the data driver 104 includes, as shown in FIG. 6, a shift register 120 for sequentially generating a sampling signal, a latch 122 for latching the N-bit digital data signal Data in response to the sampling signal, a digital/analog converter 124 for selecting any one of a plurality of gamma voltages GMA based on the latched N-bit digital data signal Data and generating the selected gamma voltage GMA as the analog data voltage Vdata corresponding to the digital data signal Data, a modulator 130 for generating the modulated data voltage Vmdata for acceleration of the response speed of the liquid crystal according to the M-bit data value of the latched N-bit digital data signal Data, a mixer 126 for mixing the modulated data voltage Vmdata with the analog data voltage Vdata, and an output unit 128 for buffering the mixed data voltage Vp and supplying the buffered data voltage to the data lines DL.

The shift register 120 sequentially generates and supplies the sampling signal to the latch 122 in response to a source start pulse SSP and a source shift clock SSC included in the data control signal DCS from the timing controller 108.

The latch 122 latches the N-bit digital data signal Data from the timing controller 108 in response to the sampling signal from the shift register 120 on a horizontal line-by-horizontal line basis. The latch 122 also supplies the latched N-bit digital data signal Data of one horizontal line to the digital/analog converter 124 in response to a source output enable signal SOE included in the data control signal DCS from the timing controller 108.

Figure 7A:
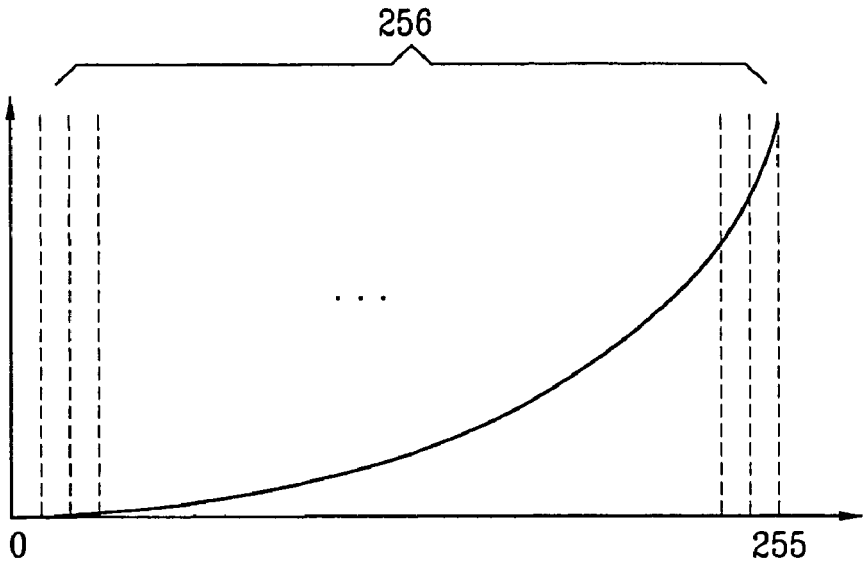
FIG. 7A is a view illustrating the levels of gamma voltages which are supplied to a digital/analog converter in FIG. 6, or the levels of modulated data voltages which are outputted from a modulator in FIG. 6.

The digital/analog converter 124, by selecting any one of the plurality of gamma voltages GMA, which are supplied from a gamma voltage generator, not shown, according to the N-bit digital data signal Data from the latch 122, converts the N-bit digital data signal Data into the analog data voltage Vdata and supplies the converted analog data voltage Vdata to the mixer 126. Preferably, when the N-bit digital data signal Data is of 8 bits, the plurality of gamma voltages GMA have 256 different levels, as shown in FIG. 7A. In this case, the digital/analog converter 124 selects any one of the gamma voltages GMA of the 256 different levels corresponding to the N-bit digital data signal Data from the latch 122 and generates the selected gamma voltage as the analog data voltage Vdata.

The modulator 130 generates the modulated data voltage Vmdata for acceleration of the response speed of the liquid crystal according to the digital data signal Data of the M bits of the N bits outputted from the latch 122 and supplies the generated data voltage Vmdata to the mixer 126.

In detail, the modulator 130 generates a modulated data voltage Vmdata having a different level and a different pulse width depending on the M-bit digital data signal Data supplied from the latch 122.

Figure 7B:
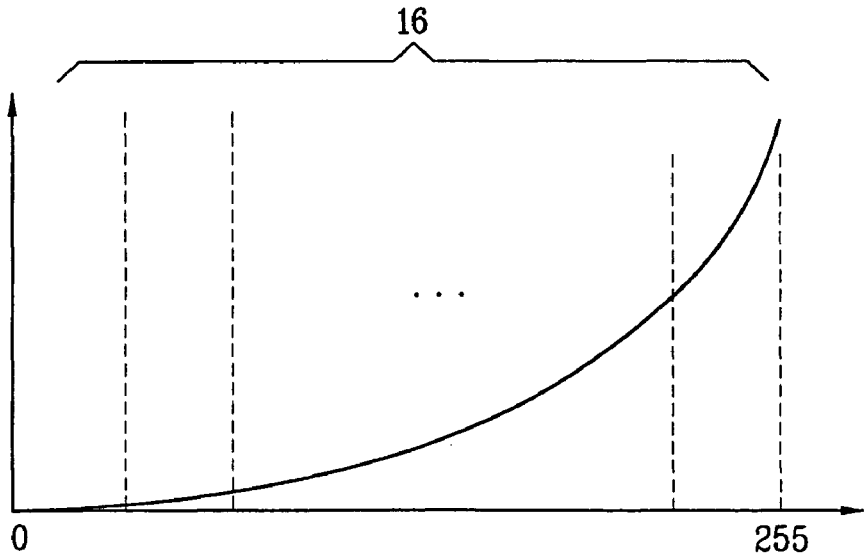
FIG. 7B is a view illustrating the levels of the modulated data voltages which are outputted from the modulator in FIG. 6.

When the M-bit digital data signal Data inputted from the latch 122 is 8 bits, the modulator 130 generates modulated data voltages Vmdata having 256 different levels and pulse widths. However, when the M-bit digital data signal Data inputted to the modulator 130 is 8 bits, the modulator 130 is increased in size. For this reason, it is assumed in the present invention that the digital data signal Data of the four most significant bits MSB1 to MSB4 of the 8 bits outputted from the latch 122 is supplied to the modulator 130. Thus, the modulator 130 generates a modulated data voltage Vmdata having any one of 16 different levels and any one of 16 different pulse widths, as shown in FIG. 7B, on the basis of the four most significant bits MSB1 to MSB4 from the latch 122, and supplies the generated modulated data voltage Vmdata to the mixer 126.

The mixer 126 mixes the modulated data voltage Vmdata from the modulator 130 with the analog data voltage Vdata from the digital/analog converter 124 and supplies the mixed data voltage Vp to the output unit 128.

The output unit 128 supplies the data voltage Vp from the mixer 126 to the data lines DL.

Figure 8:
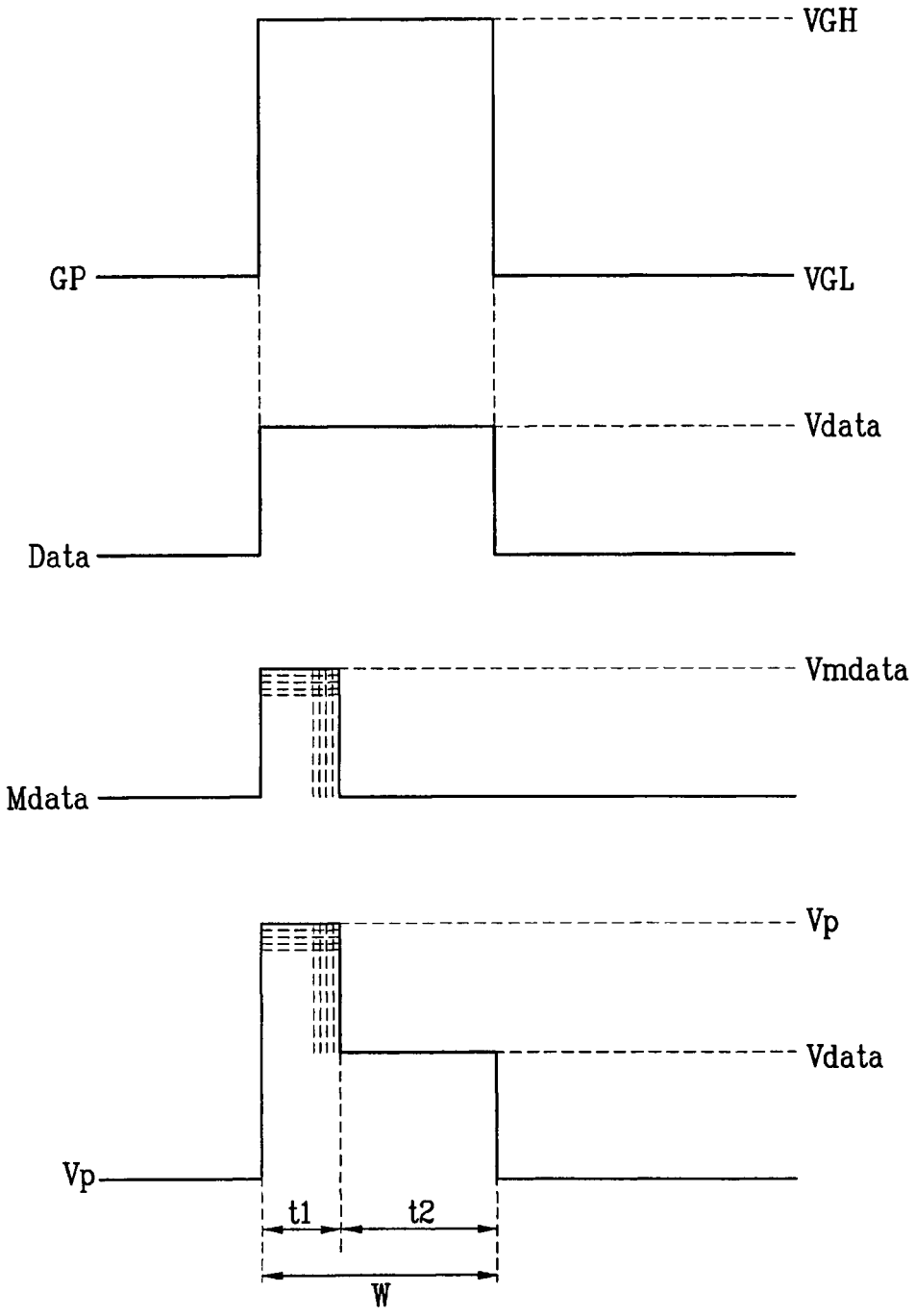
FIG. 8 is a waveform diagram illustrating waveforms which are supplied to gate lines and data lines of a liquid crystal panel in FIG. 5.

FIG. 8 is a waveform diagram of a gate pulse GP and data voltage Vp which are supplied to the liquid crystal panel 102 in FIG. 5 for one horizontal period.

Referring to FIG. 8 in connection with FIG. 6, a gate pulse GP with a certain width W from the gate driver 106 is supplied to the gate line GL of the liquid crystal panel 102. Synchronously with this gate pulse GP, the mixer 126 supplies the mixed data voltage Vp of the analog data voltage Vdata from the digital/analog converter 124 and the modulated data voltage Vmdata from the modulator 130 to the data line DL of the liquid crystal panel 102 for a first period t1 of the gate pulse GP in which a gate high voltage VGH is supplied to the gate line. Then, the analog data voltage Vdata from the digital/analog converter 124 is supplied to the data line DL of the liquid crystal panel 102 for a second period t2 of the gate pulse GP subsequent to the first period t1 in which the gate high voltage VGH is supplied to the gate line. Preferably, the first period t1 is shorter than the second period t2.

Therefore, in the driving apparatus and method of the liquid crystal display device according to the embodiment of the present invention, the liquid crystal is pre-driven with a voltage higher than the analog data voltage Vdata by supplying the data voltage Vp including the modulated data voltage Vmdata to the data line DL in the first period t1 of the gate pulse GP which is supplied to the gate line GL, and then driven in a desired state by supplying an analog data voltage Vp of a desired gray scale to the data line DL in the second period t2 of the gate pulse GP. In other words, in the driving apparatus and method of the liquid crystal display device according to the embodiment of the present invention, the liquid crystal is driven at high speed with the mixed data voltage of the modulated data voltage Vmdata and analog data voltage Vdata in the first period t1 of the scan period of the liquid crystal panel 102, and then normally driven with the analog data voltage Vdata in the second period t2 subsequent to the first period t1.

Hence, in the driving apparatus and method of the liquid crystal display device according to the embodiment of the present invention, it is possible to increase the response speed of the liquid crystal even without using a separate memory, so as to prevent degradation in picture quality.

Figure 9:
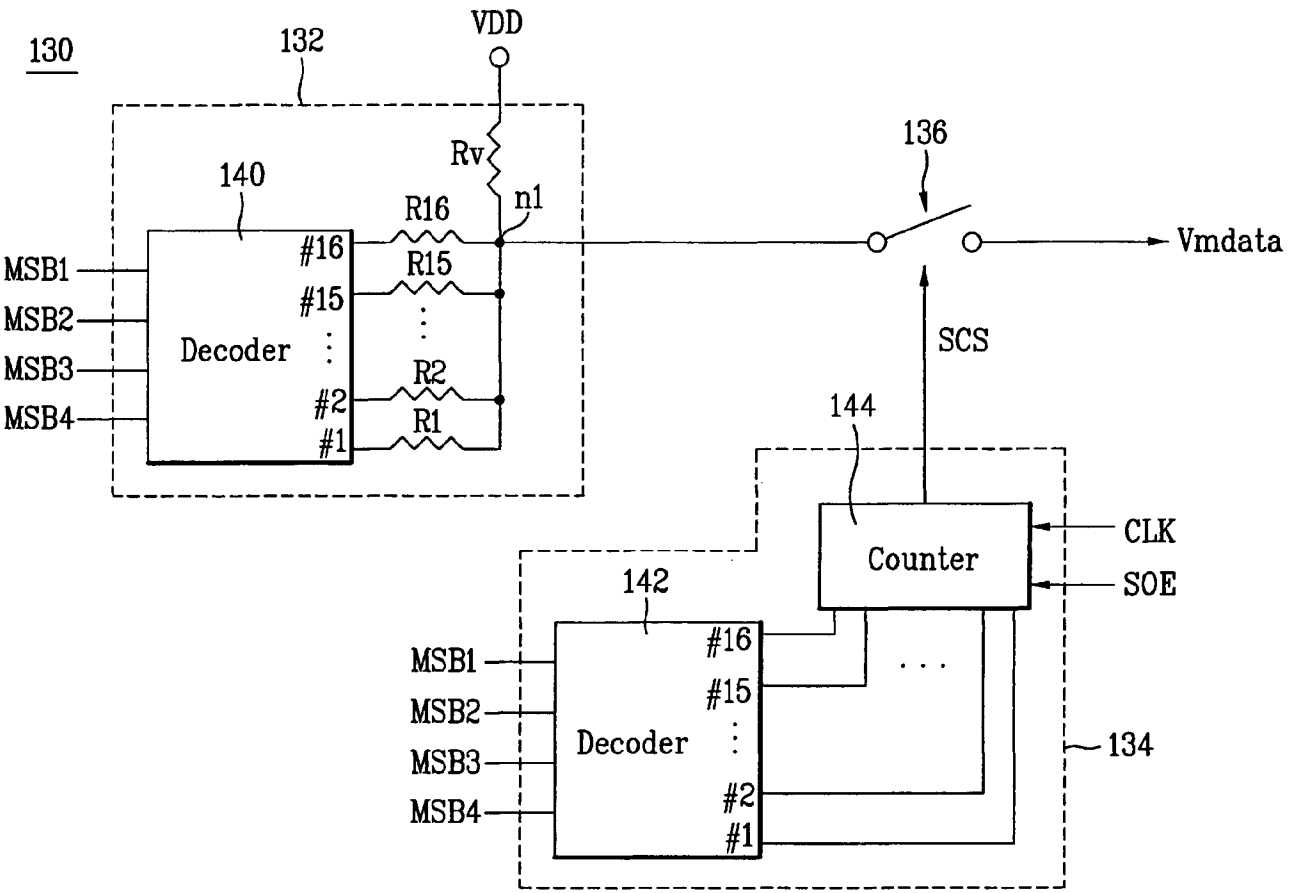
FIG. 9 is a view showing a first embodiment of the modulator in FIG. 6.

FIG. 9 shows a first embodiment of the modulator 130 in the driving apparatus of the liquid crystal display device according to the embodiment of the present invention shown in FIGS. 5 and 6.

Referring to FIG. 9 in connection with FIG. 6, the modulator 130 according to the first embodiment includes a modulated voltage generator 132 for generating the modulated data voltage Vmdata having the different level according to a 4-most significant bit digital data signal (MSB1 to MSB4) from the latch 122, a switching control signal generator 134 for generating a switching control signal SCS having a different pulse width according to the 4-most significant bit digital data signal (MSB1 to MSB4) from the latch 122, and a switch 136 for supplying the modulated data voltage Vmdata from an output node n1 of the modulated voltage generator 132 to the mixer 126 in response to the switching control signal SCS.

The modulated voltage generator 132 includes a first decoder 140 for decoding the 4-most significant bit digital data signal (MSB1 to MSB4) from the latch 122 and outputting the decoded signal at a plurality of output terminals thereof, a plurality of voltage-dividing resistors R1 to R16 connected respectively to the output terminals of the first decoder 140, and a first resistor Rv electrically connected between a drive voltage terminal VDD and each of the voltage-dividing resistors R1 to R16.

The voltage-dividing resistors R1 to R16 have different resistances and are electrically connected between the output node n1 and the corresponding output terminals of the first decoder 140. The first resistor Rv and the plurality of voltage-dividing resistors R1 to R16 constitute a voltage divider circuit for setting the level of a data voltage modulated by the decoding of the first decoder 140.

The first decoder 140 decodes the 4-most significant bit digital data signal (MSB1 to MSB4) from the latch 122 to selectively connect any one of the plurality of voltage-dividing resistors R1 to R16 to an internal ground voltage source. As a result, the drive voltage VDD is divided by the first resistor Rv and the selectively connected voltage-dividing resistor and the divided voltage appears at the output node n1 as the modulated data voltage Vmdata. At this time, the modulated data voltage Vmdata can be expressed by the following Equation 3:

$$Vmdata = \frac{Rx}{Rv + Rx} \times VDD \qquad \text{[Equation 3]}$$

In the Equation 3, Rx is any one of the plurality of voltage-dividing resistors R1 to R16.

In this manner, the modulated voltage generator 132 supplies the modulated data voltage Vmdata with the different level to the switch 136 by selectively connecting any one of the plurality of voltage-dividing resistors R1 to R16 to the internal ground voltage source according to the 4-most significant bit digital data signal (MSB1 to MSB4) from the latch 122.

The switching control signal generator 134 includes a second decoder 142 for decoding the 4-most significant bit digital data signal (MSB1 to MSB4) from the latch 122, and a counter 144 for counting a clock signal CLK correspondingly to the decoded signal from the second decoder 142 to generate the switching control signal SCS with the different pulse width, and supplying the generated switching control signal SCS to the switch 136 synchronously with the source output enable signal SOE.

The second decoder 142 decodes the 4-most significant bit digital data signal (MSB1 to MSB4) from the latch 122 and supplies the resulting decoded signal with a different value to the counter 144.

The counter 144 counts the clock signal CLK by the decoded value from the second decoder 142 to generate the switching control signal SCS having the pulse width corresponding to the decoded value. The counter 144 then supplies the generated switching control signal SCS to the switch 136 synchronously with the source output enable signal SOE. Alternatively, the counter 144 may supply the generated switching control signal SCS to the switch 136 synchronously with the gate pulse GP, not the source output enable signal SOE.

The switch 136 is turned on in response to the switching control signal SCS from the counter 144 in switching control signal generator 134 to supply the modulated data voltage Vmdata from the output node n1 of the modulated voltage generator 132 to the mixer 126. At this time, the switch 136 supplies the modulated data voltage Vmdata to the mixer 126 for a period corresponding to the pulse width of the switching control signal SCS.

In this manner, the modulator 130 according to the first embodiment generates the modulated data voltage Vmdata and the switching control signal SCS according to the 4-most significant bit digital data signal (MSB1 to MSB4) from the latch 122 and sets the level and pulse width of the modulated data voltage Vmdata to be supplied to the mixer 126.

Therefore, in the driving apparatus and method of the liquid crystal display device including the modulator 130 according to the first embodiment, the liquid crystal is driven at high speed with the mixed data voltage of the modulated data voltage Vmdata with a level and pulse width corresponding to the M-bit digital data signal Data and the analog data voltage Vdata in the first period t1 of the scan period of the liquid crystal panel 102, and then normally driven with the analog data voltage Vdata in the second period t2 subsequent to the first period t1.

Preferably, the modulator 130 according to the first embodiment further includes a buffer, not shown, disposed between the output node n1 of the modulated voltage generator 132 and the switch 136. The buffer functions to buffer the modulated data voltage Vmdata from the output node n1 of the modulated voltage generator 132 and supply the buffered data voltage to the switch 136.

On the other hand, although the modulator 130 according to the first embodiment has been disclosed as using only the four most significant bits of the 8-bit digital data signal Data outputted from the latch 122, the present invention is not limited thereto. For example, the modulator 130 may generate and supply the modulated data voltage Vmdata with the different level and pulse width to the mixer 126 according to the 4-most significant bits all the way up to the full 8-bit digital data signal Data.

Figure 10:
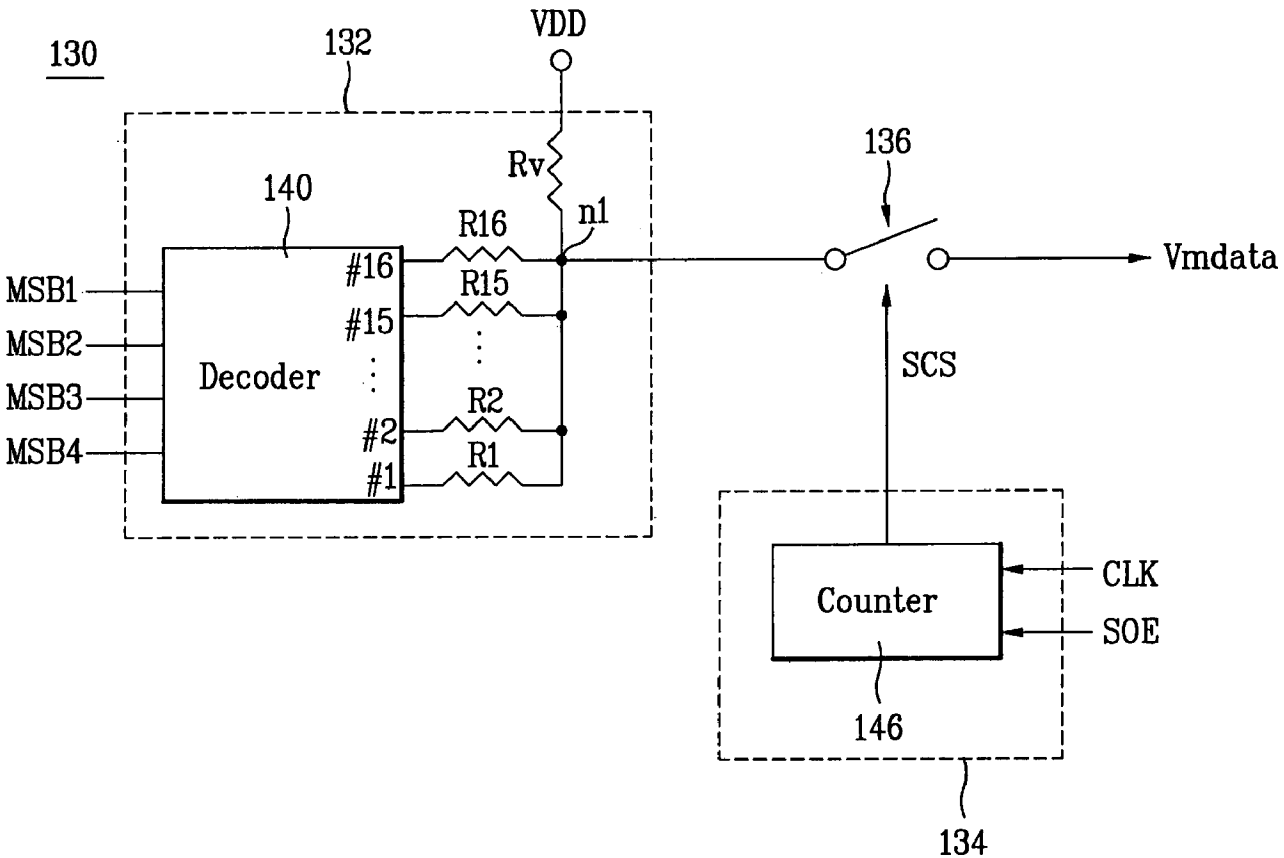
FIG. 10 is a view showing a second embodiment of the modulator in FIG. 6.

FIG. 10 shows a second embodiment of the modulator 130 in the driving apparatus of the liquid crystal display device according to the embodiment of the present invention shown in FIGS. 5 and 6.

Referring to FIG. 10 in connection with FIG. 6, the modulator 130 according to the second embodiment is the same in construction as that according to the first embodiment shown in FIG. 9, with the exception of the switching control signal generator 134. Therefore, a description will be omitted of the components other than the switching control signal generator 134.

The switching control signal generator 134 of the modulator 130 according to the second embodiment includes a counter 146 for counting the clock signal CLK up to a predetermined value to generate a switching control signal SCS with a fixed pulse width, and supplying the generated switching control signal SCS to the switch 136 synchronously with the source output enable signal SOE.

The counter 146 counts the clock signal CLK up to the predetermined value to generate the switching control signal SCS. The counter 146 then supplies the generated switching control signal SCS to the switch 136 synchronously with the source output enable signal SOE.

Alternatively, the counter 146 may supply the generated switching control signal SCS to the switch 136 synchronously with the gate pulse GP, not the source output enable signal SOE.

In this manner, the switching control signal generator 134 in the modulator 130 according to the second embodiment generates the switching control signal SCS with the fixed pulse width through the use of the counter 146 to control the switch 136. As a result, a modulated data voltage Vmdata with a fixed pulse width is supplied to the mixer 126 irrespective of the M-bit digital data signal Data.

Therefore, in the driving apparatus and method of the liquid crystal display device including the modulator 130 according to the second embodiment, the liquid crystal is driven at high speed with the mixed data voltage of the modulated data voltage Vmdata having a fixed pulse width and a level corresponding to the M-bit digital data signal Data and the analog data voltage Vdata in the first period t1 of the scan period of the liquid crystal panel 102, and then normally driven with the analog data voltage Vdata in the second period t2 subsequent to the first period t1.

Figure 11:
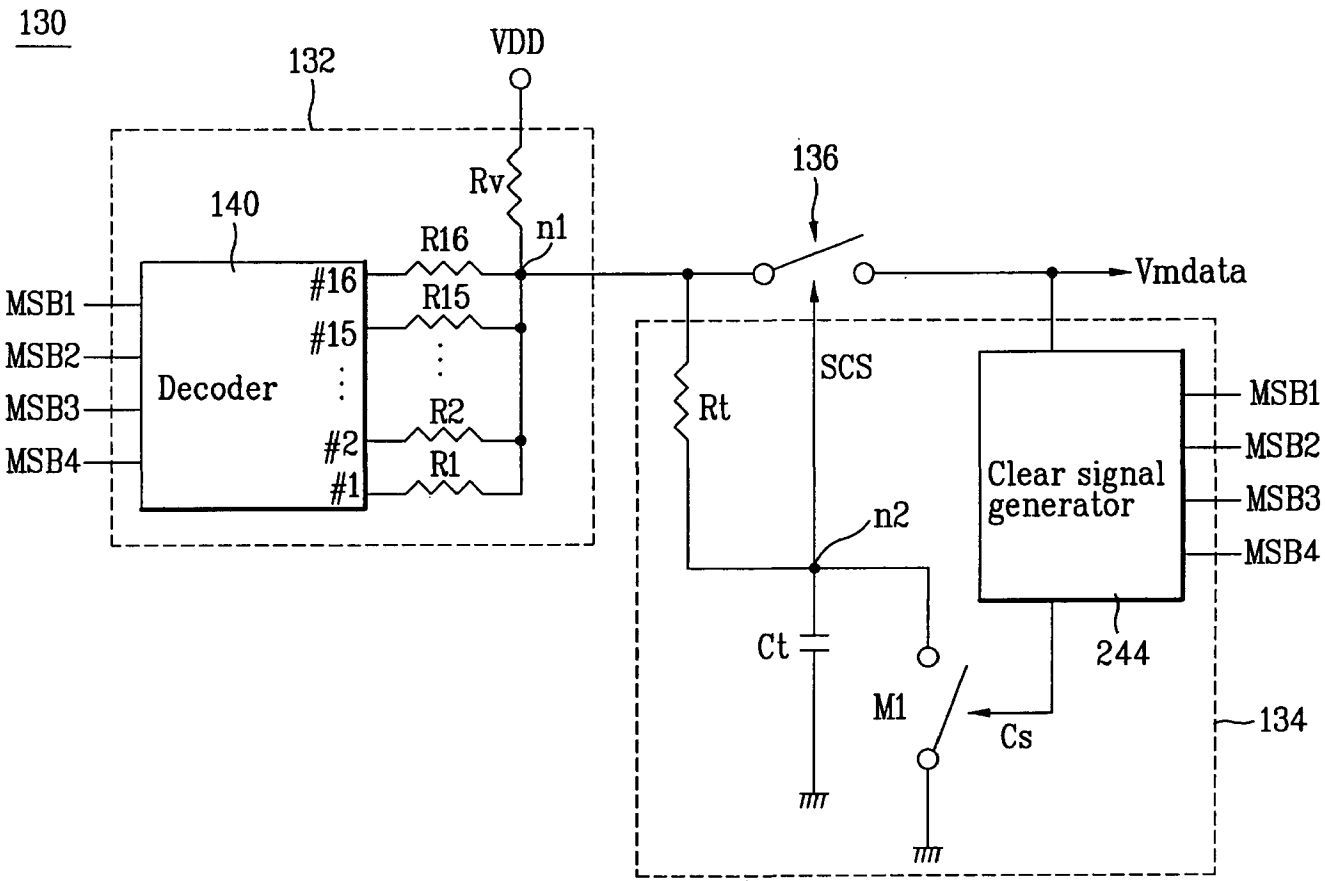
FIG. 11 is a view showing a third embodiment of the modulator in FIG. 6.

FIG. 11 shows a third embodiment of the modulator 130 in the driving apparatus of the liquid crystal display device according to the embodiment of the present invention shown in FIGS. 5 and 6.

Referring to FIG. 11 in connection with FIG. 6, the modulator 130 according to the third embodiment is the same in construction as that according to the first embodiment shown in FIG. 9, with the exception of the switching control signal generator 134. Therefore, a description will be omitted of the components other than the switching control signal generator 134.

The switching control signal generator 134 of the modulator 130 according to the third embodiment includes a resistor Rt electrically connected between a first node n1, which is the output node of the modulated voltage generator 132, and a second node n2, which is a control terminal of the switch 136, a first capacitor Ct and a transistor M1 connected in parallel between the second node n2 and a ground voltage source, and a clear signal generator 244 for decoding the modulated data voltage Vmdata outputted through the switch 136 according to the 4-most significant bit digital data signal (MSB1 to MSB4) from the latch 122 to generate a clear signal Cs for turning the transistor M1 on/off.

The resistor Rt supplies a voltage at the first node n1 to the second node n2. The first capacitor Ct constitutes an RC circuit with the resistor Rt to turn on a voltage at the second node n2, namely, the switch 136. As a result, while a voltage is charged on the first capacitor Ct by the RC circuit of the first capacitor Ct and resistor Rt, the switch 136 is turned on to supply the modulated data voltage Vmdata from the modulated voltage generator 132 to the mixer 126.

The transistor M1 electrically connects the second node n2 to the ground voltage source in response to the clear signal Cs from the clear signal generator 244 so as to discharge the voltage charged on the first capacitor Ct.

The clear signal generator 244 decodes the modulated data voltage Vmdata which is supplied to the mixer 126 through the switch 136, according to the 4-most significant bit digital data signal (MSB1 to MSB4) from the latch 122, to generate the clear signal Cs.

Figure 12:
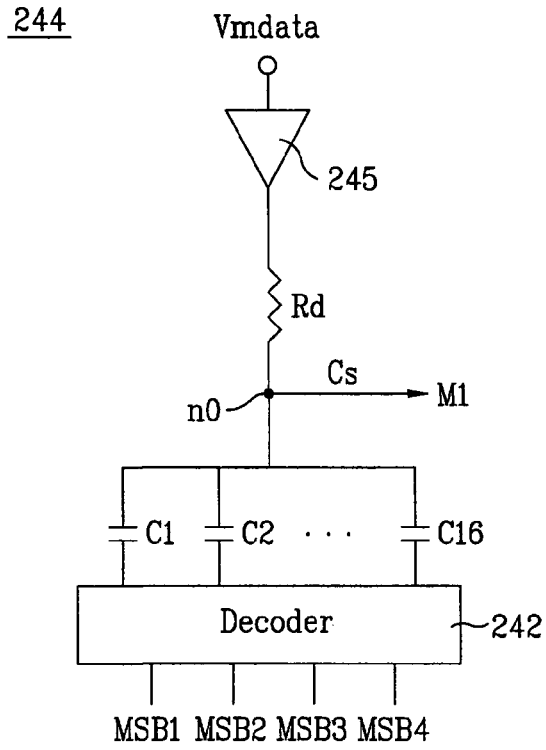
FIG. 12 is a view showing a first embodiment of a clear signal generator in FIG. 11.

To this end, the clear signal generator 244 includes, as shown in FIG. 12, a buffer 245 for buffering the modulated data voltage Vmdata which is supplied to the mixer 126, a resistor Rd electrically connected between an output terminal n0 of the clear signal generator 244, which is connected to a control terminal of the transistor M1, and the buffer 245, a plurality of second capacitors C1 to C16 connected in parallel to the output terminal n0, and a second decoder 242 for selecting any one of the second capacitors C1 to C16 according to the 4-most significant bit digital data signal (MSB1 to MSB4) from the latch 122.

The buffer 245 buffers the modulated data voltage Vmdata which is supplied to the mixer 126 through the switch 136, and supplies the buffered voltage to the resistor Rd.

Figure 13:
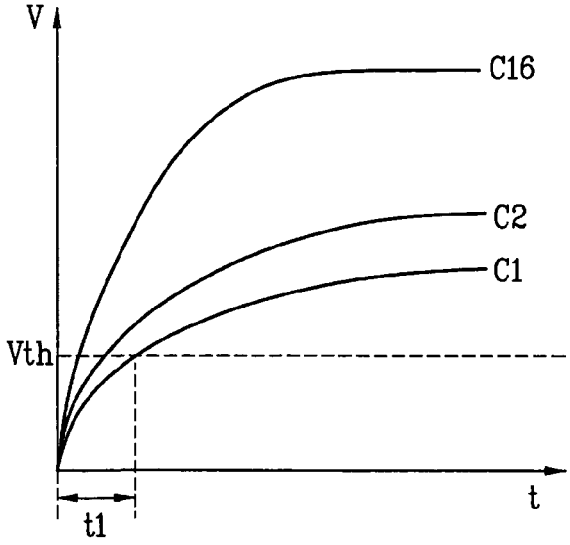
FIG. 13 is a waveform diagram illustrating voltages stored in respective capacitors in FIG. 12.

Each of the second capacitors C1 to C16 has a first electrode electrically connected to the output terminal n0, and a second electrode electrically connected to the second decoder 242. These capacitors C1 to C16 have different capacitances, so that they have charging characteristics as shown in FIG. 13.

The second decoder 242 decodes the 4-most significant bit digital data signal (MSB1 to MSB4) from the latch 122 to selectively connect the second electrode of any one of the plurality of second capacitors C1 to C16 to an internal ground voltage source. As a result, the selectively connected second capacitor and the resistor Rt constitute an RC circuit.

With this configuration, the clear signal generator 244 selects any one of the second capacitors C1 to C16 according to the 4-most significant bit digital data signal (MSB1 to MSB4) from the latch 122 and connects the selected second capacitor to the ground voltage source, so as to charge the voltage inputted through the buffer 245 on the selected second capacitor. Thus, the clear signal generator 244 generates a clear signal Cs corresponding to the voltage charged on the second capacitor selected by the second decoder 242, and supplies the generated clear signal Cs to the transistor M1.

The clear signal Cs has a first logic state when the voltage charged on the selected one of the second capacitors C1 to C16 is lower than a threshold voltage Vth of the transistor M1, and a second logic state when the charged voltage is higher than or equal to the threshold voltage Vth of the transistor M1. Preferably, the second logic state has a voltage level capable of turning on the transistor M1, and the first logic state has a voltage level capable of turning off the transistor M1.

As being turned on by the clear signal Cs of the second logic state generated depending on the capacitance of each of the second capacitors C1 to C16, the transistor M1 discharges the voltage at the second node n2 to the ground voltage source. As a result, the switching control signal generator 134 sets the time t1 for which the modulated data voltage Vmdata is supplied to the mixer 126, by generating a switching control signal SCS with a different pulse width based on the clear signal Cs generated according to the 4-most significant bit digital data signal (MSB1 to MSB4).

Figure 14:
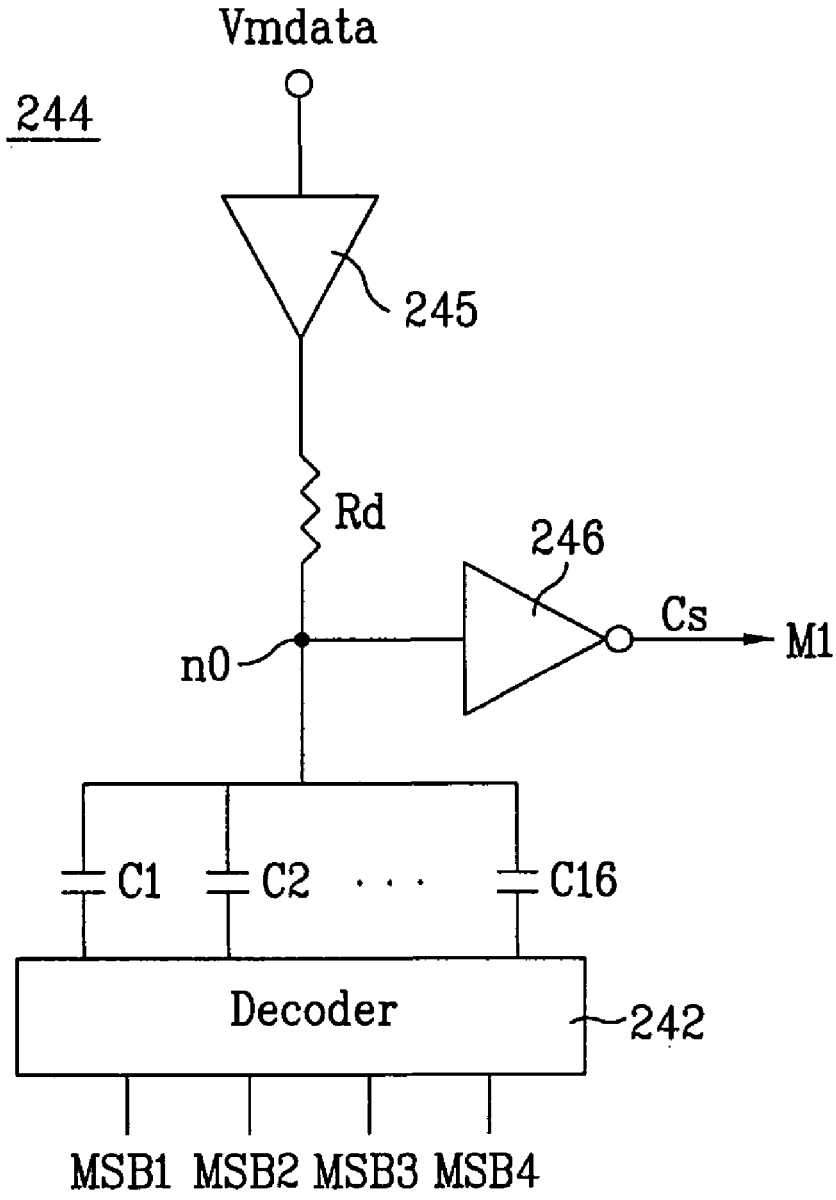
FIG. 14 is a view showing a second embodiment of the clear signal generator in FIG. 11.

Alternatively, the clear signal generator 244 may further include, as shown in FIG. 14, an inverter 246 connected between the output terminal n0 and the control terminal of the transistor M1.

The inverter 246 inverts the clear signal Cs from the output terminal n0 and supply the inverted clear signal to the control terminal of the transistor M1. In this case, the transistor M1 is preferably of a P type.

As another alternative, the clear signal generator 244 may further include two inverters which are connected between the output terminal n0 and the control terminal of the transistor M1 to invert the clear signal Cs from the output terminal n0 two times and supply the non-inverted clear signal to the control terminal of the transistor M1. In this case, the transistor M1 is preferably of an N type.

In this manner, the switching control signal generator 134 in the modulator 130 according to the third embodiment generates the clear signal Cs corresponding to the M-bit digital data signal Data to control the switch 136. As a result, a modulated data voltage Vmdata with a different level and different pulse width depending on the M-bit digital data signal Data is supplied to the mixer 126.

In other words, the switching control signal generator 134 in the modulator 130 according to the third embodiment turns on the switch 136 through the use of the first capacitor Ct and resistor Rt to supply a modulated data voltage Vmdata having a different pulse width and a level corresponding to the M-bit digital data signal Data to the mixer 126 in the first period t1 of the gate pulse GP. The switching control signal generator 134 also turns off the switch 136 by generating the clear signal Cs corresponding to the M-bit digital data signal Data to discharge the voltage stored in the first capacitor Ct in the second period t2 of the gate pulse GP.

Therefore, in the driving apparatus and method of the liquid crystal display device including the modulator 130 according to the third embodiment, the liquid crystal is driven at high speed with the mixed data voltage of the modulated data voltage Vmdata having a different pulse width and a level corresponding to the M-bit digital data signal Data and the analog data voltage Vdata in the first period t1 of the scan period of the liquid crystal panel 102, and then normally driven with the analog data voltage Vdata in the second period t2 subsequent to the first period t1.

Figure 15:
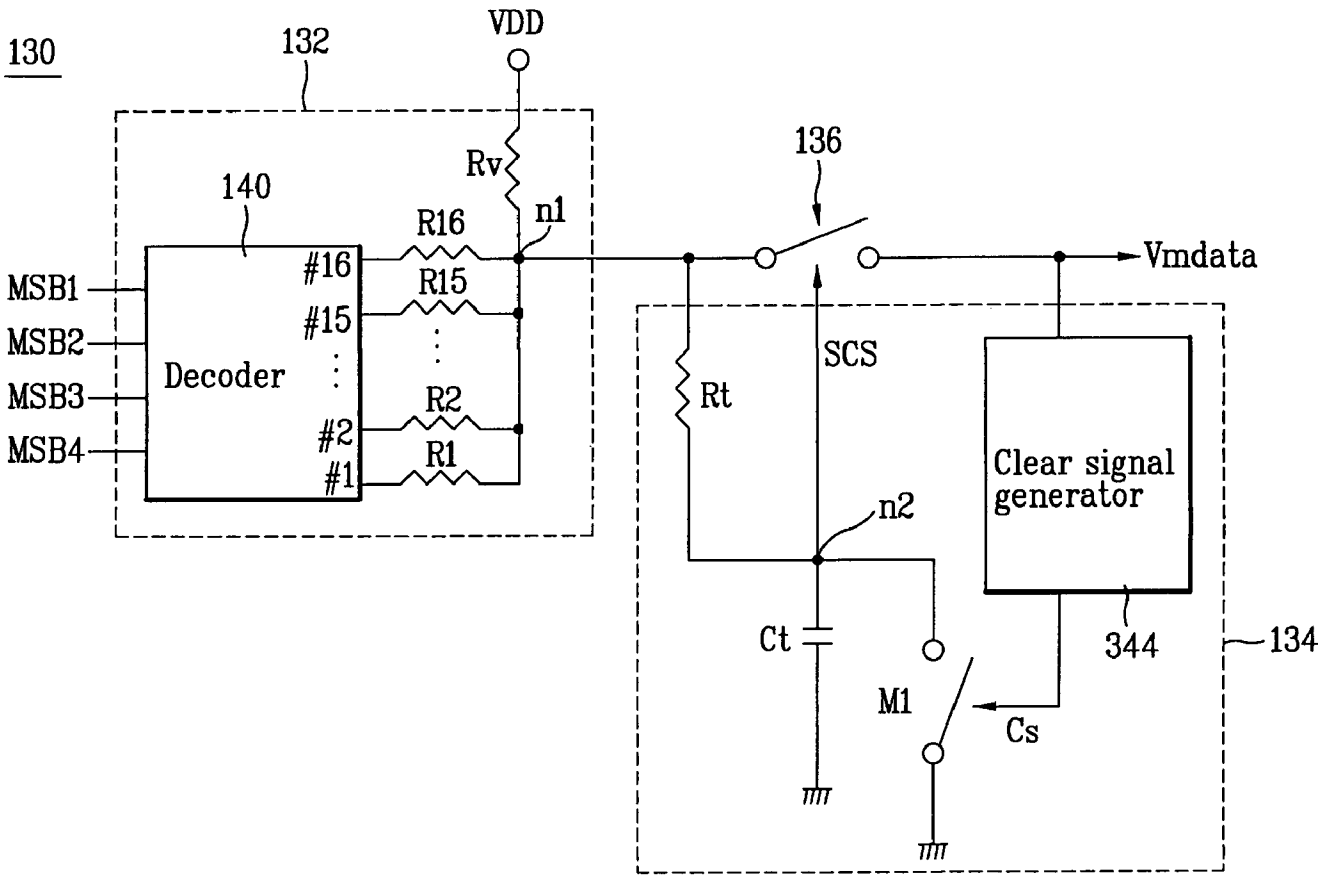
FIG. 15 is a view showing a fourth embodiment of the modulator in FIG. 6.

FIG. 15 shows a fourth embodiment of the modulator 130 in the driving apparatus of the liquid crystal display device according to the embodiment of the present invention shown in FIGS. 5 and 6.

Referring to FIG. 15 in connection with FIG. 6, the modulator 130 according to the fourth embodiment is the same in construction as that according to the first embodiment shown in FIG. 9, with the exception of the switching control signal generator 134. Therefore, a description will be omitted of the components other than the switching control signal generator 134.

The switching control signal generator 134 of the modulator 130 according to the fourth embodiment includes a resistor Rt electrically connected between a first node n1, which is the output node of the modulated voltage generator 132, and a second node n2, which is a control terminal of the switch 136, a first capacitor Ct and a transistor M1 connected in parallel between the second node n2 and a ground voltage source, and a clear signal generator 344 for generating a clear signal Cs for turning the transistor M1 on/off, using the modulated data voltage Vmdata outputted through the switch 136.

The resistor Rt supplies a voltage at the first node n1 to the second node n2. The first capacitor Ct constitutes an RC circuit with the resistor Rt to turn on a voltage at the second node n2, namely, the switch 136. As a result, while a voltage is charged on the first capacitor Ct by the RC circuit of the first capacitor Ct and resistor Rt, the switch 136 is turned on to supply the modulated data voltage Vmdata from the modulated voltage generator 132 to the mixer 126.

The transistor M1 electrically connects the second node n2 to the ground voltage source in response to the clear signal Cs from the clear signal generator 344 so as to discharge the voltage charged on the first capacitor Ct.

The clear signal generator 344 generates the clear signal Cs for turning the transistor M1 on/off, using the modulated data voltage Vmdata which is supplied to the mixer 126 through the switch 136.

Figure 16:
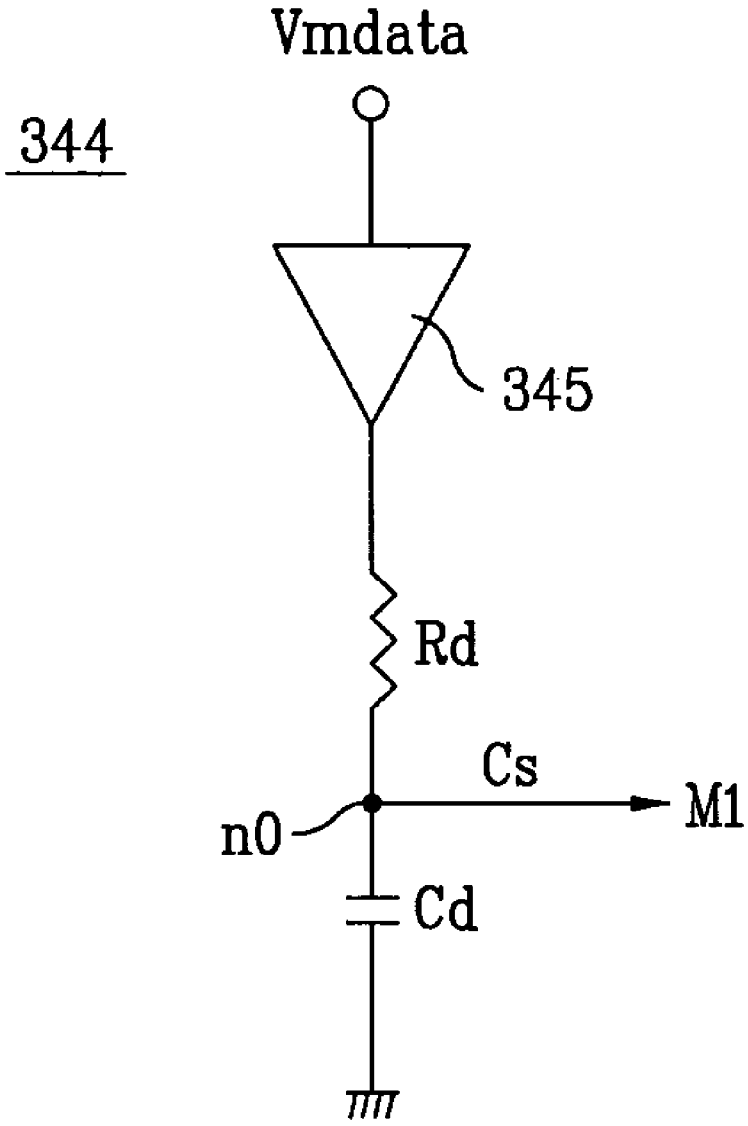
FIG. 16 is a view showing the configuration of a clear signal generator in FIG. 15.

To this end, the clear signal generator 344 includes, as shown in FIG. 16, a buffer 345 for buffering the modulated data voltage Vmdata, a resistor Rd electrically connected between an output terminal n0 of the clear signal generator 344, which is connected to a control terminal of the transistor M1, and the buffer 345, and a second capacitor Cd electrically connected between the output terminal n0 and the ground voltage source.

The buffer 345 buffers the modulated data voltage Vmdata which is supplied to the mixer 126, and supplies the buffered voltage to the resistor Rd.

The resistor Rd and the second capacitor Cd cooperate to delay the modulated data voltage Vmdata supplied from the buffer 345 by an RC time constant to generate the clear signal Cs, and supply the generated clear signal Cs to the control terminal of the transistor M1. The RC time constant of the resistor Rd and second capacitor Cd is set to a value to turn the transistor M1 on by generating the clear signal Cs for the second period t2 of the gate pulse GP supplied to the gate line.

Alternatively, the clear signal generator 344 may further include at least one inverter connected between the output terminal n0 and the control terminal of the transistor M1.

In this manner, the switching control signal generator 134 in the modulator 130 according to the fourth embodiment turns on the switch 136 through the use of the first capacitor Ct and resistor Rt to supply a modulated data voltage Vmdata having a fixed pulse width and a level corresponding to the M-bit digital data signal Data to the mixer 126 in the first period t1 of the gate pulse GP. The switching control signal generator 134 also turns off the switch 136 by discharging the voltage stored in the first capacitor Ct in the second period t2 of the gate pulse GP through the use of the clear signal generator 344 and transistor M1.

Therefore, in the driving apparatus and method of the liquid crystal display device including the modulator 130 according to the fourth embodiment, the liquid crystal is driven at high speed with the mixed data voltage of the modulated data voltage Vmdata having a fixed pulse width and a level corresponding to the M-bit digital data signal Data and the analog data voltage Vdata in the first period t1 of the scan period of the liquid crystal panel 102, and then normally driven with the analog data voltage Vdata in the second period t2 subsequent to the first period t1.

Figure 17:
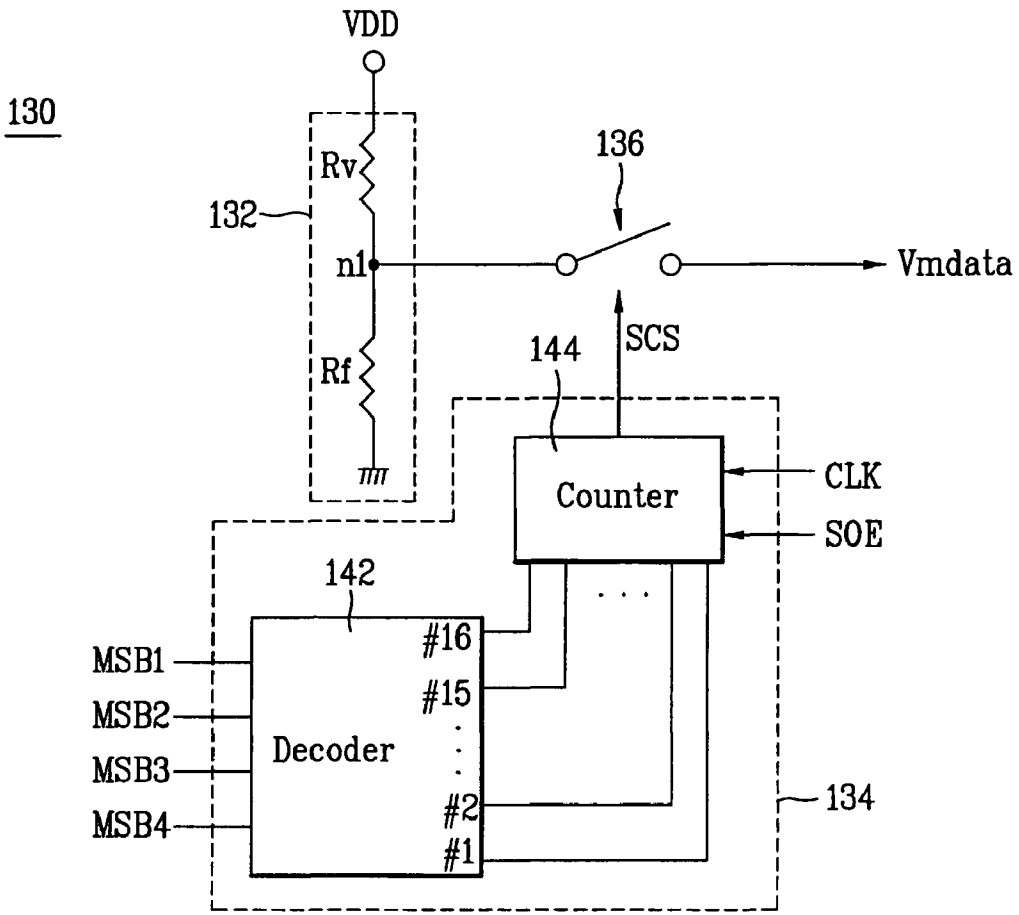
FIG. 17 is a view showing a fifth embodiment of the modulator in FIG. 6.

FIG. 17 shows a fifth embodiment of the modulator 130 in the driving apparatus of the liquid crystal display device according to the embodiment of the present invention shown in FIGS. 5 and 6.

Referring to FIG. 17 in connection with FIG. 6, the modulator 130 according to the fifth embodiment is the same in construction as that according to the first embodiment shown in FIG. 9, with the exception of the modulated voltage generator 132. Therefore, a description will be omitted of the components other than the modulated voltage generator 132.

The modulated voltage generator 132 of the modulator 130 according to the fifth embodiment includes first and second voltage-dividing resistors Rv and Rf connected in series between a drive voltage VDD and a ground voltage, and an output node n1 provided between the first and second voltage-dividing resistors Rv and Rf and electrically connected to the switch 136.

The first and second voltage-dividing resistors Rv and Rf cooperate to divide the drive voltage VDD by their resistances and supply the divided voltage of a fixed level to the switch 136.

In this manner, the modulated voltage generator 132 of the modulator 130 according to the fifth embodiment generates the modulated data voltage Vmdata of the fixed level through the use of the first and second voltage-dividing resistors Rv and Rf and supplies the generated data voltage to the switch 136.

Therefore, in the driving apparatus and method of the liquid crystal display device including the modulator 130 according to the fifth embodiment, the liquid crystal is driven at high speed with the mixed data voltage of the modulated data voltage Vmdata having a level fixed irrespective of the M-bit digital data signal Data and a pulse width based on the M-bit digital data signal Data and a analog data voltage Vdata in the first period t1 of the scan period of the liquid crystal panel 102, and then normally driven with the analog data voltage Vdata in the second period t2 subsequent to the first period t1.

Figure 18:
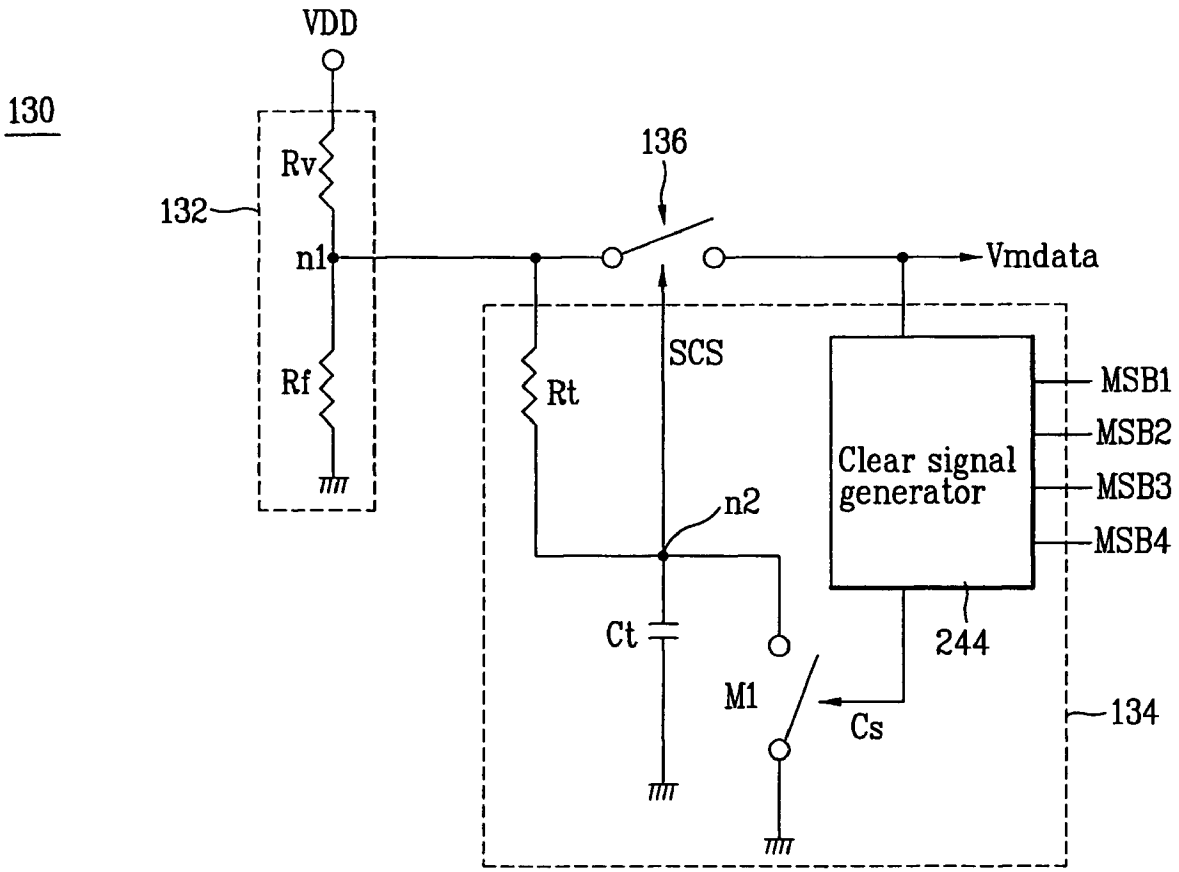
FIG. 18 is a view showing a sixth embodiment of the modulator in FIG. 6.

FIG. 18 shows a sixth embodiment of the modulator 130 in the driving apparatus of the liquid crystal display device according to the embodiment of the present invention shown in FIGS. 5 and 6.

Referring to FIG. 18 in connection with FIG. 6, the modulator 130 according to the sixth embodiment is the same in construction as that according to the third embodiment shown in FIG. 11, with the exception of the modulated voltage generator 132. Therefore, a description will be omitted of the components other than the modulated voltage generator 132.

The modulated voltage generator 132 of the modulator 130 according to the sixth embodiment includes first and second voltage-dividing resistors Rv and Rf connected in series between a drive voltage VDD and a ground voltage, and an output node n1 provided between the first and second voltage-dividing resistors Rv and Rf and electrically connected to the switch 136.

The first and second voltage-dividing resistors Rv and Rf cooperate to divide the drive voltage VDD by their resistances and supply the divided voltage of a fixed level to the switch 136.

In this manner, the modulated voltage generator 132 of the modulator 130 according to the sixth embodiment generates the modulated data voltage Vmdata of the fixed level through the use of the first and second voltage-dividing resistors Rv and Rf and supplies the generated data voltage to the switch 136.

Therefore, in the driving apparatus and method of the liquid crystal display device including the modulator 130 according to the sixth embodiment, the liquid crystal is driven at high speed with a mixed data voltage of a modulated data voltage Vmdata having a level fixed irrespective of the M-bit digital data signal Data and a pulse width based on the M-bit digital data signal Data and the analog data voltage Vdata in the first period t1 of the scan period of the liquid crystal panel 102, and then normally driven with the analog data voltage Vdata in the second period t2 subsequent to the first period t1.

As apparent from the above description, the present invention provides a driving apparatus and method of a liquid crystal display device in which a liquid crystal is pre-driven with a modulated data voltage higher than an analog data voltage corresponding to a digital data signal by supplying a data voltage including the modulated data voltage to a data line in a first period of a gate pulse which is supplied to a gate line, and then driven in a desired state by supplying an analog data voltage of a desired gray scale to the data line in a second period of the gate pulse.

Therefore, in the driving apparatus and method of the liquid crystal display device according to the present invention, it is possible to increase the response speed of the liquid crystal without using a separate memory, so as to prevent degradation in picture quality. Furthermore, because a separate memory is not used, it is possible to decrease the cost of the liquid crystal display.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving a liquid crystal display device, comprising:

a liquid crystal panel including a plurality of gate lines and a plurality of data lines arranged perpendicularly to each other;

a gate driver that supplies a gate pulse to the gate lines; and a data driver that samples an input N-bit digital data signal to generate an analog data voltage, generates a modulated data voltage according to an M-bit data value of the sampled digital data signal, mixes the modulated data voltage with the analog data voltage to form a mixed data voltage, and supplies the mixed data voltage to the data lines, wherein N and M are positive integers and M is smaller than or equal to N, and wherein the data driver includes, a shift register that generates a sampling signal;

a latch that latches the N-bit digital data signal in response to the sampling signal and outputs the latched N-bit digital data signal in response to a data output enable signal (SOE);

a digital/analog converter that converts the N-bit digital data signal from the latch into the analog data voltage;

a modulator that generates a modulated data voltage according to an M-bit data value of the sampled digital N-bit data signal from the latch; and a mixer that mixes the modulated data voltage with the analog data voltage to form the mixed data voltage and outputs the mixed data voltage to the data lines.

2. The apparatus as set forth in claim 1, wherein the mixed data voltage has a magnitude greater than the analog data voltage.

3. The apparatus as set forth in claim 1, wherein the data driver uses only means other than a digital memory to generate the modulated data voltage.

4. The apparatus as set forth in claim 1, wherein the data driver supplies the mixed data voltage to the data lines in a first period of the gate pulse and supplies the analog data voltage to the data lines in a second period of the gate pulse.

5. The apparatus as set forth in claim 4, wherein the first period of the gate pulse is shorter than the second period of the gate pulse.

6. The apparatus as set forth in claim 1, wherein the modulated data voltage has a level and a pulse width, at least one of which is modulated according to the M-bit digital data signal.

7. The apparatus as set forth in claim 1, wherein the modulator includes:

a modulated voltage generator that sets a level of the modulated data voltage;

a switching control signal generator that generates a switching control signal to set a pulse width of the modulated data voltage; and a switch that supplies the modulated data voltage from the modulated voltage generator to the mixer in response to the switching control signal.

8. The apparatus as set forth in claim 7, wherein the modulated voltage generator includes:

a first decoder that decodes the M-bit digital data signal to generate a first decoded signal;

a first resistor connected between a drive voltage terminal and an output node of the modulated voltage generator; and a plurality of voltage-dividing resistors connected between the output node of the modulated voltage generator and the first decoder dividing a drive voltage from the drive voltage terminal in response to the first decoded signal to vary a voltage level of the output node of the modulated voltage generator.

9. The apparatus as set forth in claim 7, wherein the modulated voltage generator includes first and second resistors connected between a drive voltage terminal and a ground voltage source dividing a drive voltage from the drive voltage terminal into the modulated data voltage of a fixed level by resistances thereof and supplying the divided voltage to the switch.

10. The apparatus as set forth in claim 7, wherein the switching control signal generator includes:

a decoder that decodes the M-bit digital data signal to generate a decoded signal; and a counter that counts an input clock signal by the decoded signal to generate the switching control signal with a different pulse width, and supplies the generated switching control signal to the switch.

11. The apparatus as set forth in claim 10, wherein the switching control signal is supplied to the switch synchronously with the data output enable signal or the gate pulse.

12. The apparatus as set forth in claim 7, wherein the switching control signal generator includes a counter that counts an input clock signal by a predetermined value to generate the switching control signal with a fixed pulse width, and supplies the generated switching control signal to the switch.

13. The apparatus as set forth in claim 12, wherein the switching control signal is supplied to the switch synchronously with the data output enable signal or the gate pulse.

14. The apparatus as set forth in claim 7, wherein the switching control signal generator includes:

a resistor connected between an output node of the modulated voltage generator and a control terminal of the switch;

a capacitor connected between the control terminal of the switch and a ground voltage source that generates the switching control signal;

a clear signal generator that decodes the modulated data voltage outputted through the switch according to the M-bit digital data signal to generate a clear signal; and a transistor disposed between the control terminal of the switch and the ground voltage source that discharges a voltage stored in the capacitor in response to the clear signal.

15. The apparatus as set forth in claim 14, wherein the clear signal generator includes:

a buffer that buffers the modulated data voltage;

a resistor connected between an output terminal of the clear signal generator, which is connected to a control terminal of the transistor, and the buffer;

a plurality of capacitors connected in parallel to the output terminal; and a second decoder that selects at least one of the plurality of capacitors according to the M-bit digital data signal.

16. The apparatus as set forth in claim 15, wherein the clear signal generator further includes an inverter connected between the output terminal and the control terminal of the transistor.

17. The apparatus as set forth in claim 7, wherein the switching control signal generator includes:

a resistor connected between an output node of the modulated voltage generator and a control terminal of the switch;

a capacitor connected between the control terminal of the switch and a ground voltage source that generates the switching control signal;

a clear signal generator that generates a clear signal using the modulated data voltage outputted through the switch; and a transistor disposed between the control terminal of the switch and the ground voltage source that discharges a voltage stored in the capacitor in response to the clear signal.

18. The apparatus as set forth in claim 17, wherein the clear signal generator includes:

a buffer that buffers the modulated data voltage;

a resistor connected between an output terminal of the clear signal generator, which is connected to a control terminal of the transistor, and the buffer; and a capacitor connected between the output terminal and the ground voltage source.

19. The apparatus as set forth in claim 18, wherein the clear signal generator further includes an inverter connected between the output terminal and the control terminal of the transistor.

20. A method for driving a liquid crystal panel which includes a plurality of gate lines and a plurality of data lines arranged perpendicularly to each other, comprising:

sampling an input N-bit digital data signal to generate an analog data voltage;

generating a modulated data voltage for acceleration of a response speed of a liquid crystal according to an M-bit data value of the sampled digital data signal, wherein N and M are positive integers and M is smaller than or equal to N, and;

supplying a gate pulse to the gate lines; and mixing the modulated data voltage with the analog data voltage to form a mixed data voltage and supplying the mixed data voltage to the data lines synchronously with the gate pulse.

21. The method as set forth in claim 20, wherein the mixed data voltage is supplied to the data lines in a first period of the gate pulse, and the analog data voltage is supplied to the data lines in a second period of the gate pulse.

22. The apparatus as set forth in claim 21, wherein the first period of the gate pulse is shorter than the second period of the gate pulse.

23. The method as set forth in claim 21, wherein the modulated data voltage has a level and a pulse width, at least one of which is modulated according to the M-bit digital data signal.

24. The method as set forth in claim 23, wherein generating the modulated data voltage comprises:

setting the level of the modulated data voltage;

generating a switching control signal to set the pulse width of the modulated data voltage; and controlling a switch in response to the switching control signal to generate the modulated data voltage having the set level and pulse width.

25. The method as set forth in claim 24, wherein setting the level of the modulated data voltage comprises:

selectively connecting at least two resistors among a plurality of resistors in response to the M-bit digital data signal; and dividing a drive voltage using the selectively connected resistors to generate the modulated data voltage.

26. The method as set forth in claim 24, wherein setting the level of the modulated data voltage comprises dividing a drive voltage into the modulated data voltage of a fixed level using first and second resistors connected between the drive voltage and a ground voltage source to generate the modulated data voltage.

27. The method as set forth in claim 24, wherein generating the switching control signal comprises:

counting an input clock signal dependent on the M-bit digital data signal to generate the switching control signal with a different pulse width, and supplying the generated switching control signal to the switch.

28. The method as set forth in claim 27, wherein the switching control signal is supplied to the switch synchronously with the gate pulse.

29. The method as set forth in claim 24, wherein generating the switching control signal comprises counting an input clock signal by a predetermined value to generate the switching control signal with a fixed pulse width, and supplying the generated switching control signal to the switch.

30. The method as set forth in claim 29, wherein the switching control signal is supplied to the switch synchronously with the gate pulse.

31. The method as set forth in claim 24, wherein generating the switching control signal comprises:

storing the modulated data voltage inputted to the switch in a first capacitor to generate the switching control signal;

buffering the modulated data voltage outputted through the switch and storing the buffered voltage in at least one of a plurality of second capacitors through a resistor dependent on the M-bit digital data signal; and generating a clear signal according to the voltage stored in the at least one second capacitor to discharge the voltage stored in the first capacitor.

32. The method as set forth in claim 24, wherein generating the switching control signal comprises:

storing the modulated data voltage inputted to the switch in a first capacitor to generate the switching control signal;

buffering the modulated data voltage outputted through the switch and storing the buffered voltage in a second capacitor through a resistor; and generating a clear signal according to the voltage stored in the second capacitor to discharge the voltage stored in the first capacitor.

* * * * *